US008733760B1

(12) United States Patent
Fontana

(10) Patent No.: US 8,733,760 B1
(45) Date of Patent: May 27, 2014

(54) GAME AND METHOD OF PLAYING A GAME

(71) Applicant: André Fontana, Buenos Aires (AR)

(72) Inventor: André Fontana, Buenos Aires (AR)

( * ) Notice: Subject to any disclaimer, the term of this patent is extended or adjusted under 35 U.S.C. 154(b) by 0 days.

(21) Appl. No.: 13/684,063

(22) Filed: Nov. 21, 2012

(51) Int. Cl.
*A63F 9/18* (2006.01)
*A63F 1/00* (2006.01)

(52) U.S. Cl.
USPC ..... 273/302; 273/308; 273/430; 273/431; 273/432

(58) Field of Classification Search
USPC ..... 273/308, 302, 430–432, 249, 243
See application file for complete search history.

(56) References Cited

U.S. PATENT DOCUMENTS

| | | | | |
|---|---|---|---|---|
| 2,177,078 | A | 10/1939 | Raizen et al. | |
| 4,315,627 | A | 2/1982 | Schlegel et al. | |
| 4,566,698 | A * | 1/1986 | Sneden | 273/249 |
| 4,807,878 | A | 2/1989 | Tripp | |
| 4,889,345 | A | 12/1989 | Wawryk | |
| 4,900,031 | A * | 2/1990 | Wohl | 273/243 |
| 4,932,667 | A | 6/1990 | Gorski et al. | |
| 4,984,805 | A * | 1/1991 | Medlock | 273/248 |
| 5,066,016 | A | 11/1991 | O'Neill | |
| 5,121,928 | A | 6/1992 | Salerno-Sonneberg | |
| 5,186,467 | A | 2/1993 | Chasin | |
| 5,193,818 | A | 3/1993 | Leeson | |
| 5,472,207 | A | 12/1995 | Sullivan, Jr. et al. | |
| 5,480,157 | A * | 1/1996 | Plummer | 273/432 |
| 6,017,035 | A | 1/2000 | Glasser et al. | |
| 6,145,839 | A | 11/2000 | Katsion et al. | |
| 6,227,543 | B1 | 5/2001 | Balog et al. | |
| 6,267,376 | B1 | 7/2001 | Jenkins | |
| 6,761,358 | B2 | 7/2004 | Hallett | |
| 2002/0043764 | A1 * | 4/2002 | Imhof | 273/292 |
| 2003/0052456 | A1 | 3/2003 | Lasko et al. | |
| 2005/0225031 | A1 | 10/2005 | Brown | |
| 2007/0145686 | A1 | 6/2007 | Wisniewski | |
| 2010/0264585 | A1 * | 10/2010 | Berke et al. | 273/240 |

* cited by examiner

*Primary Examiner* — Benjamin Layno

(57) ABSTRACT

A game and a method of playing a game are disclosed. A card with an image of a celebrity printed thereon is drawn by a player on a team. The player also starts a timing device, indicating his time of play, and manipulates a random number generator to obtain a random number. Within the given time of play, the player must recite a number of facts about the celebrity, corresponding to the random number, with players on an opposing team attempting to hinder the player's rotation of facts by playing disadvantage cards, and teammates on the player's team attempting to assist the player by playing benefit cards and/or help cards. Points are assigned based on recitation of the assigned number of facts related to the respective celebrity, and after multiple rounds of play are concluded, the points are tallied for the teams and a winner is declared.

8 Claims, 9 Drawing Sheets

| | | | | |
|---|---|---|---|---|
| TEAMS | 1 | 2 | 3 | 4 |
| PLAYERS | ANDRE | HELENA | MICHAEL | ANDREA |
| TURNS | POINTS | | | |
| 1 | | | | |
| 2 | | | | |
| 3 | | | | |
| SPECIAL ROUND | | | | |
| 4 | | | | |
| 5 | | | | |
| 6 | | | | |
| SPECIAL ROUND | | | | |
| 7 | | | | |
| 8 | | | | |
| 9 | | | | |
| SPECIAL ROUND | | | | |
| 10 | | | | |
| 11 | | | | |
| 12 | | | | |
| SPECIAL ROUND | | | | |
| 13 | | | | |
| 14 | | | | |
| 15 | | | | |
| SPECIAL ROUND | | | | |
| 16 | | | | |
| TOTALS | | | | |
| TEAM TOTAL | | | | |

72 74 76 78 81 70 56 80 82

FIG. 8

GAME AND METHOD OF PLAYING A GAME

FIELD OF THE INVENTION

The present invention relates to a game and a method of playing the game. More particularly, the invention relates to a game wherein players, under pressure of a time clock, draw cards containing images of celebrities, e.g., movie stars, and have to recite a certain number of facts related to the celebrity, e.g., titles of movies the star appeared in, the number of facts being dictated by a random number generated by a random number generator.

BACKGROUND OF THE INVENTION

Trivia games requiring one or more players on opposing teams to recite facts about a celebrity are known. Known trivia games, however, typically require either a board, and pieces moving about the board, or else require players to act out trivial facts related to the celebrity. The known games, therefore, require space to play; are difficult to play in a confined space, where a board does not conveniently fit, such as a coffee table, a relatively small desk in an apartment or college dormitory room, a seat on an airplane, a seat on a train; and are difficult to play in a location where nearby non-players would be disturbed by players acting out facts about the celebrity. Alternately, if players want to spread the game out in a larger space, the confines of the board may prevent doing so. In addition, many existing trivia games take an excessively long time to play, causing many players lose interest and quit before the game concludes. Such games also tend to be entertaining only for players very knowledgeable of celebrity trivia, and much less entertaining for players less knowledgeable of celebrity trivia. Finally, such games typically are designed for only one class of celebrity, e.g., celebrity actors, athletes, artists, singers, musicians, politicians, historical figures or the like, but are not easily adaptable for many classes of celebrities.

The present invention solves the above issues with the known games by providing a game which is easily played by two teams of players, which can be played either in a relatively confined space, or in a larger space, according to the players' preference without acting out trivia; which incorporates multiple possible correct answers; which maintains interaction between all the players throughout the game; which balances a level of entertainment between more knowledgeable players and less knowledgeable players in order to enhance enjoyment of the game for all of the players; which takes an adaptable duration of time to play; which moves quickly; which is exciting; and which includes either different versions of the game for different classes of celebrities, or several classes of celebrities included in a single game.

Accordingly, the present invention is directed to an improved game and method of playing the game, that substantially obviates one or more of the problems resulting from the limitations and disadvantages of the related art, the game having the features described and claimed below.

SUMMARY OF THE INVENTION

In accordance with the invention, a game includes at least one deck of celebrity cards, each card in the deck having on one side thereof an image of a celebrity, e.g., a movie star; a random number generator operable to generate a random number corresponding to a number of facts a player on a first team must recite about the celebrity whose card is drawn by the player, e.g., a number of names of movies in which the movie star depicted on the card appeared; a timing device operable to establish a time of a round of play, within which the player must recite the required number of facts; a plurality of disadvantage cards playable by members of a second opposing team during, or after, the round of play, reciting disadvantages to hinder the player from reciting the required number of facts; a plurality of benefit cards playable by members of the first team, to benefit the player in reciting the required number of facts, and to counter disadvantages associated with the disadvantage cards played by the opposing team; and help cards distributed one to each player, playable once by another player on the same team as the player to help the player recite the required number of facts.

The game further includes a scorecard for recording points associated with each fact recited by the first player, including points associated with the required facts, and points associated with disadvantages from the disadvantage cards. In addition, a coin is included, which is flipped based on a command from the random number generator, the outcome of the flip affecting the manner in which points are scored.

Classes of celebrities depicted on different decks of celebrity cards may include, but are not limited to, movie stars, athletes, fine artists, rock stars, politicians, and historical figures. Separate versions of the game may be packaged with separate decks of celebrity cards, plus separate corresponding disadvantage cards and benefit cards, or a single game may be packaged with multiple decks of different celebrity cards, plus disadvantage cards and benefit cards corresponding to each different celebrity card deck.

Advantages of the present invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate presently a preferred embodiment of the invention and together with the description, serve to explain the principles of the invention.

BRIEF DESCRIPTION OF THE DRAWINGS

FIG. 1B is a front view of a face of a card selected from the deck of

FIG. 1A, with an image of a celebrity printed on one side thereof;

FIG. 8 depicts a scorecard;

DESCRIPTION OF THE PREFERRED EMBODIMENT

Figure 1A:
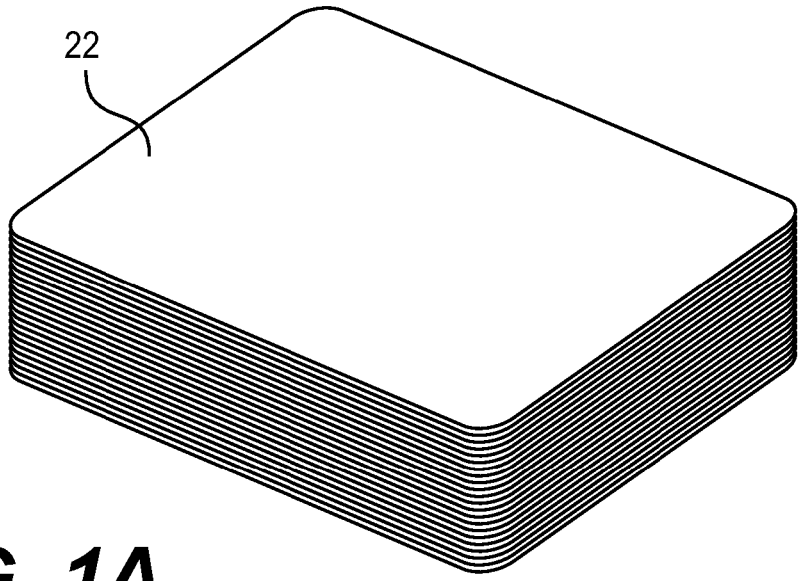
FIG. 1A is perspective view of a deck of celebrity cards.

Reference will now be made in detail to the present preferred embodiment of the invention, an example of which is illustrated in the accompanying drawings. An exemplary embodiment of a game in accordance with the invention is shown in FIGS. 1-10, and is designated generally by reference numeral 20.

Figure 1B:
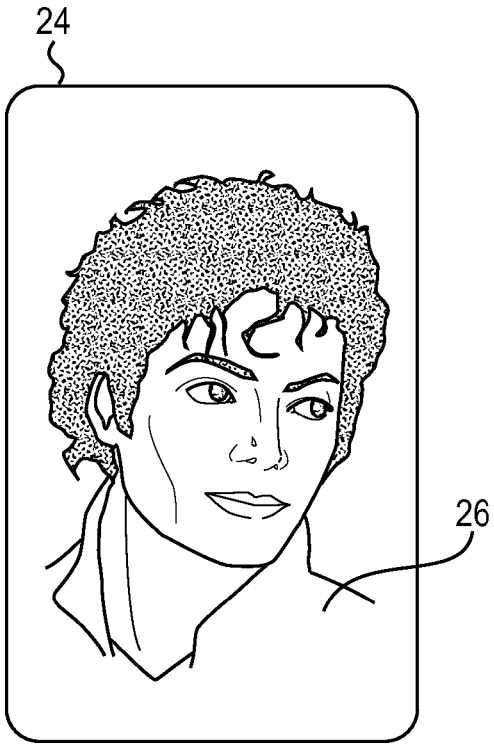

As embodied herein, and referring to FIGS. 1A and 1B, the game 20 includes a deck of celebrity cards 22, each card 24 in the deck 22 being printed, on at least one face thereof, with an image of a well-known celebrity 26. The game 20 is not limited to any single class of celebrities. For example, the game 20 can come in different versions, e.g. a "RED CARPET™ version, wherein the celebrity images 26 are e.g., images of movie stars, television stars, and stage stars, or the like; a "Sport Heroes" version wherein the celebrity images 26 are, e.g., World Cup athletes, Olympic medalists, Tour de France bicyclists, NBA® basketball stars, MLB® baseball stars, American NFL® football stars, NHL® ice hockey stars, world champion boxers and other martial art practitioners, and the like; a "Fine Arts" version, wherein the celebrity images 26 are images of famous opera tenors and sopranos, painters, composers, novelists, and the like; a "Popular Music Stars" version, wherein the celebrity images 26 are images of famous singers, rock and roll guitar players, and the like; a "Politicians" version, wherein the celebrity images 26 are images of U.S. Presidents, European royalty, Middle Eastern leaders, and the like; a "Historical Figures" version wherein the celebrities 26 are well-known historical explorers, conquerors, world-leaders, military commanders, scientists, and the like; or an all-encompassing version of the game 20, containing celebrity card decks 22 of each of the above versions. It also is within the scope of the game 20 that certain cross-over celebrities 26A may have their images in different decks of celebrity cards 22 used in more than one version of the game. For example, images of Abraham Lincoln, Franklin Delano Roosevelt, Benito Mussolini, Josef Stalin, or Eva Peron may appear on celebrity cards 24A in both the "Politicians" version and the "Historical Figures" version; whereas images of, e.g., Frank Sinatra, Beyonce Knowles and Madonna may appear on celebrity cards 24A in both the "Popular Music Stars" and the RED CARPET™ versions of the game.

In accordance with the invention, the game 20 further includes a random number generator 30 operable to generate a random number.

Figure 2A:
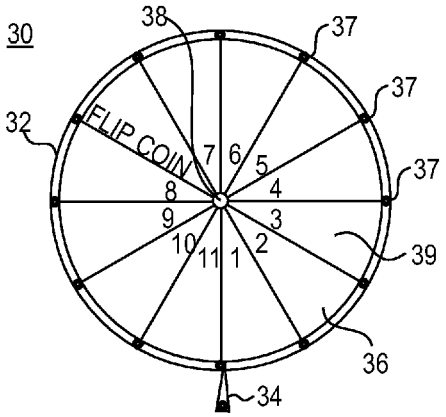
FIG. 2A is a top view of a random number generator in the form of a pivotal wheel.
Figure 2B:
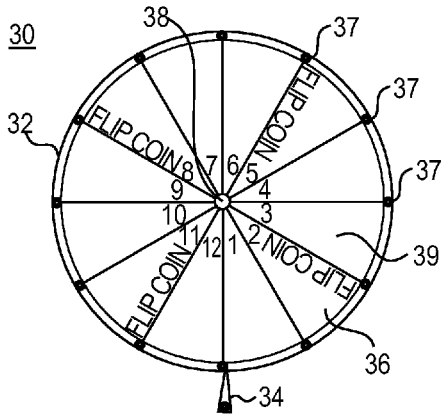
FIG. 2B is a top view of an another embodiment of a random number generator in the form of a pivotal wheel.

As broadly embodied in FIG. 2A, random number generator 30 comprises a pivotal wheel 32. The wheel 32 includes a fixed pointer 34 and a disc 36, which is pivotally mounted on a spindle 38. The disc 36 is divided into multiple discrete slots 39, each slot including a pair of stops 37 to stop the disc with the pointer 34 pointing into a slot 39 when rotation of the disc 36 slows sufficiently to be stopped. The slots 39 are annotated with numerals, e.g., 1-11, except for a slot 39 which is annotated with the expression "coin," or "flip coin." In this embodiment, the "coin" or "flip coin" slot also may correspond with the numeral 12. In an alternate embodiment, broadly depicted in FIG. 2B, all of the slots 39 are annotated with numerals 1-12, and periodic slots 39 also have the annotation "coin" or "flip coin."

Figure 2C:
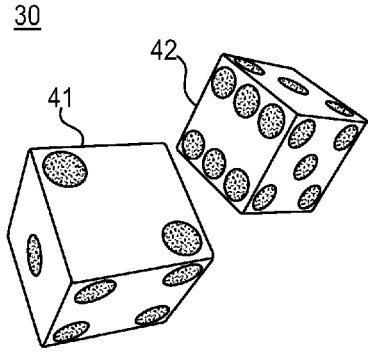
FIG. 2C is a perspective view of a random number generator in the form of a pair of dice.

The invention is not limited to use of a pivotal wheel 32 with a pivotal disc 36, as the random number generator 30. A random number generator with a fixed disc (not shown) also could be provided, with numerals printed about the periphery, and a pointer 34 which can be spun about a spindle 38, and which stops spinning pointing at a random number. Referring to FIG. 2C, random number generator 30 can comprise a pair of dice 41 and 42. When dice are used as a random number generator 30, either one die 41, or both dice 41, 42 may be used. Moreover, when a pair of dice 41, 42 are used as the random number generator 30, one number combination, e.g., 11, or 7 can be designated as the command "coin" or "flip coin." Other possible random number generators will occur to persons of ordinary skill in the art. For example, a card could be drawn from a shuffled deck of standard playing cards, with the number on the drawn card acting as the unforeseeable number. It is preferred, however that any random number generator selected be compact in order to fulfill the invention's goal of not taking up excessive space.

In accordance with the invention, the random number generated by the random number generator 30 dictates a number of facts a player must recite concerning the celebrity 26 depicted on the celebrity card 24. For example, in the RED CARPET™ version of the game, once a player draws a celebrity card 24 with a celebrity image 26 of a movie star, and receives a random number from the random number generator 30, he or she must recite, within a specified amount of time, names of a number of movies in which the star appeared, corresponding to the number generated by the random number generator.

Figure 3A:
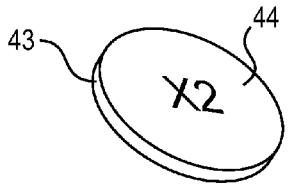
FIG. 3A is a perspective view of one face of a coin.
Figure 3B:
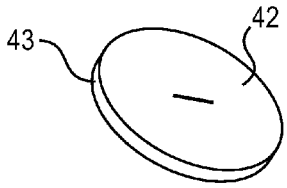
FIG. 3B is a perspective view of an opposite face of the coin of FIG. 3A.
Figure 4A:
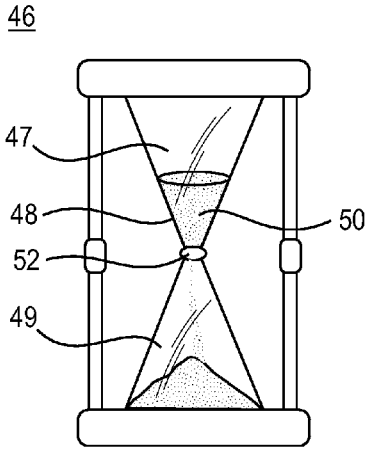
FIG. 4A is a front view of a timing device in the form of a sandglass.
Figure 4B:
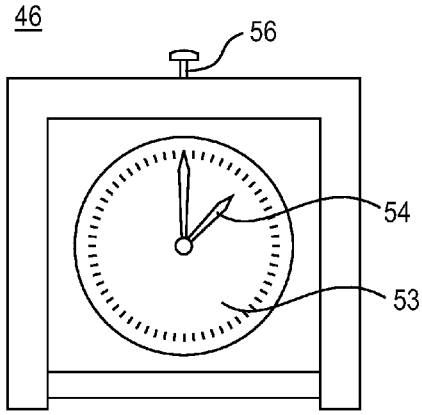
FIG. 4B is a front view of a timing device in the form of a clock.

The game further includes a coin 43, as broadly depicted in FIGS. 3A and 3B. During the game, coin 43 is flipped when so commanded by the "coin" or "flip coin" command on the random number generator 30. Different faces 44 of the coin 43 which land face-side-up will impact scoring in the game. For example if face 44, designated "X2" as shown in FIG. 3A lands face-side-up, all points scored are doubled, whereas if the face 44 designated "-" as shown in FIG. 3B lands face-side-up, and the player fails to recite the number of facts required by the random number generator, all points are negative.

As broadly embodied herein, the game 20 further comprises a timing device 46, the timing device indicating a time for a round of play for each player. As broadly embodied in FIG. 4A, timing device 46 comprises a sandglass 48, including two end portions 47 and 49 of substantially equal volume, entrapped sand 50, and a funnel 52 between the end portions 47, 49. An amount of glass 50 entrapped in the sandglass 48, and the dimensions of the funnel 52 will determine the length of time for each round of play when the sandglass 48 is flipped, e.g., two minutes, three minutes, and the like.

Timing device 46, however, is not limited to a sandglass 48. As broadly embodied in FIG. 4B, timing device 46 comprises a timing clock 53, similar to commercially available clocks used in chess tournaments with rotating hands 54, and a push-button clock starter 56. In addition, a stopwatch (not shown), a wristwatch (not shown), or a digital timing device (not shown) can be used as a timing device 46 to indicate a time of play for each round of play. Once again, whatever timing device is selected should fulfill the goal of not taking excessive space.

Figure 5B:
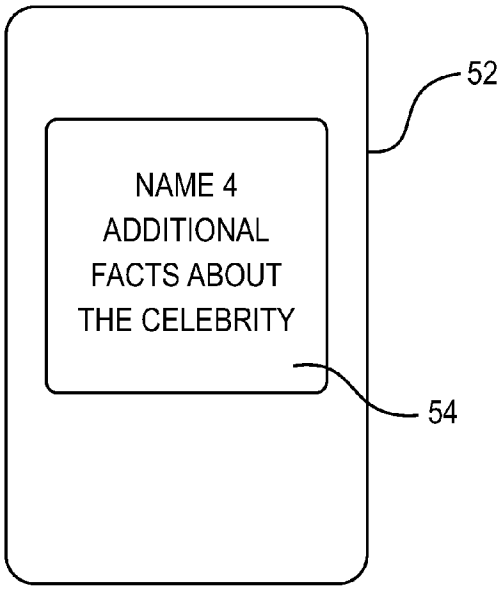
FIG. 5B is a front view of a face of a disadvantage card.
Figure 5A:
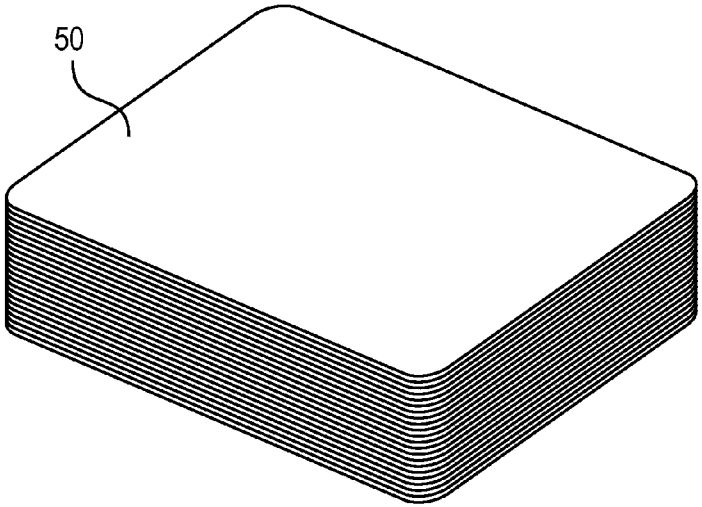
FIG. 5A is a perspective view of a deck of disadvantage cards.

In accordance with the invention, and as broadly embodied in FIGS. 5A and 5B, the game 20 further includes a deck 50 of disadvantage cards 52. Each of the disadvantage cards 52 is printed on at least one side thereof with a disadvantage command 54, playable by players on a team opposing a player playing a round, for hindering the player playing the round.

Possible disadvantage commands 54, used with respect to the RED CARPET™ version of the game, wherein the celebrity images 26 are images of movie stars include, but are not limited to, e.g., "Name "X" additional movies in which the star appeared," "recite the name of the star's character in each movie recited," "name movies for which the star won an award, e.g. an Academy Award," "recite the name of another actor or actress playing a secondary role in each movie recited," 'list movies in chronological order," "recite a television series in which the star appeared," "write the star's name," and so forth. Other disadvantage cards 52 are possible, in the RED CARPET™ version of the game. Likewise, other versions of the game include decks 50 of disadvantage cards 52 with disadvantage commands 54 corresponding to the class of celebrities 26 in the respective versions of the game. For example, in the "Popular Music Stars" version of the game, disadvantage commands may include "name songs performed by the celebrity which won an award, e.g. a Grammy Award," "name the instrument played by the celebrity," "list all bands in which the celebrity performed," and the like.

Figure 6B:
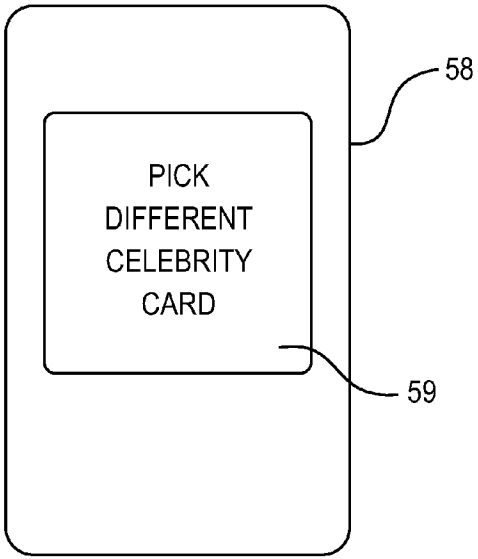
FIG. 6B is a front view of a face of a benefit card.
Figure 6A:
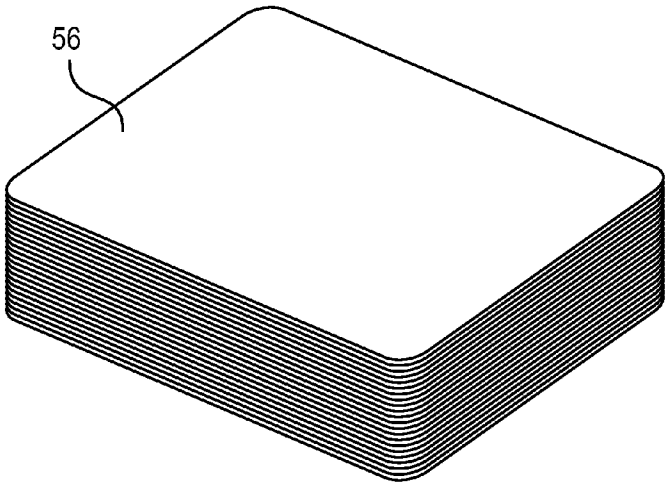
FIG. 6A is a perspective view of a deck of benefit cards.

In accordance with the invention, and as broadly embodied in FIGS. 6A and 6B, the game 20 further includes a deck 56 of benefit cards 58. Each of the benefit cards 58 is printed on at least one side thereof with a benefit command 59. The benefit cards 58 are playable by members of the player's team to assist the player during his or her round of play to recite the required number of facts, or to counter disadvantage cards played by the opposing team.

Possible benefit commands 59 include, but are not limited to, e.g., "pick another celebrity card," "operate the random number generator again to obtain a different number," "reduce the number of facts to be recited," "ask a team member for assistance," "steal points from the opposing team," and "cancel any disadvantage card or cards played by the opposing team." Other benefit cards 58 are possible in all of the different game versions. In addition, as was the case with the disadvantage cards, different versions of the game have different decks 56 of benefit cards 58 with different benefit commands 59 corresponding to the class of celebrities 26 in the respective versions of the game.

Figure 7B:
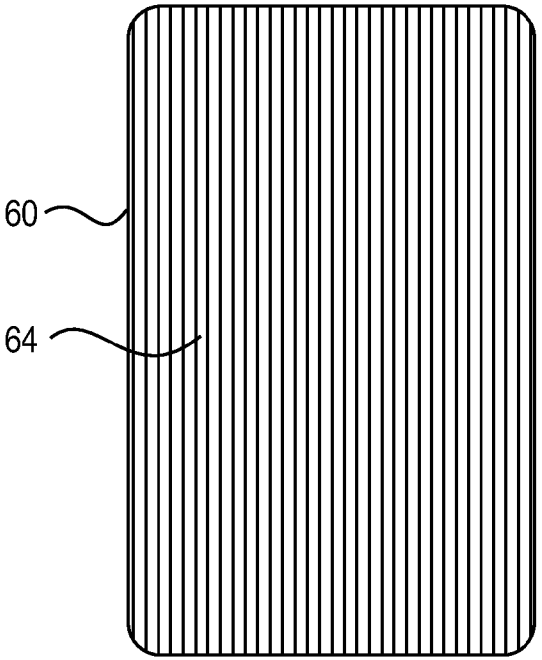
FIGS. 7A and 7B depict opposing faces of a help card.
Figure 7A:
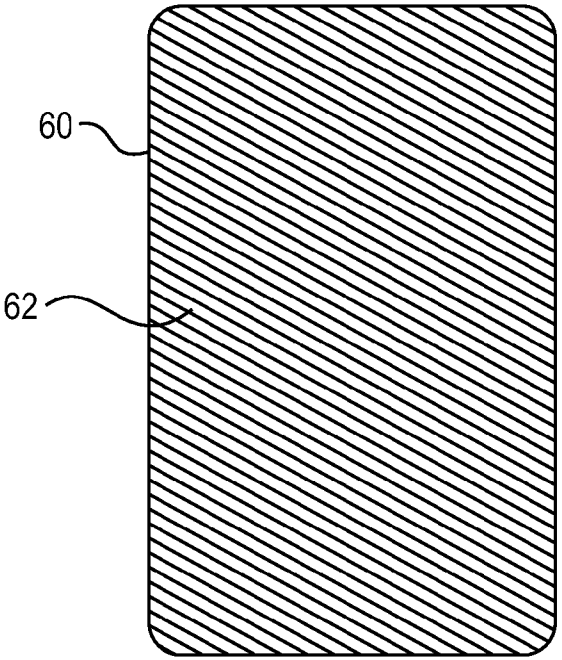

In accordance with the invention, and as broadly embodied in FIGS. 7A and 7B, a help card 60 is provided, having two opposing faces, a "help" face 62, and an "already played" face 64. The help card 60 is playable at selected times by a teammate of the player, to assist the player in reciting the required number of facts concerning the celebrity 26. The faces 64 of the help card 60 have different indicators on each respective face, preferably different colors, i.e. a green "help" face 62, and a red "already played" face 64, respectively. For example, when a teammate holding a help card 60 decides to help a player on his team playing a round, he can help the player if he has a help card 60 with the "help" face 62 face up. After the help is given, help card 60 is flipped to the "already played" face 64 to indicate that it cannot be used again during the pending round of play.

In accordance with the invention, and as broadly depicted in FIG. 8, a scorecard 70 is provided. Preferably, with reference to FIG. 8, scorecard 70 includes horizontal and vertical columns 72, 74, 76, 80, 81 and 82 for lists of teams, names of individual players, individual player point subtotals, Special Round point subtotals, and each team's final score.

A method of playing the game 20 in accordance with the invention will be described in detail below, with respect to a sample game layout depicted in FIG. 9 and with respect to a flowchart depicted in FIG. 10.

Figure 9:
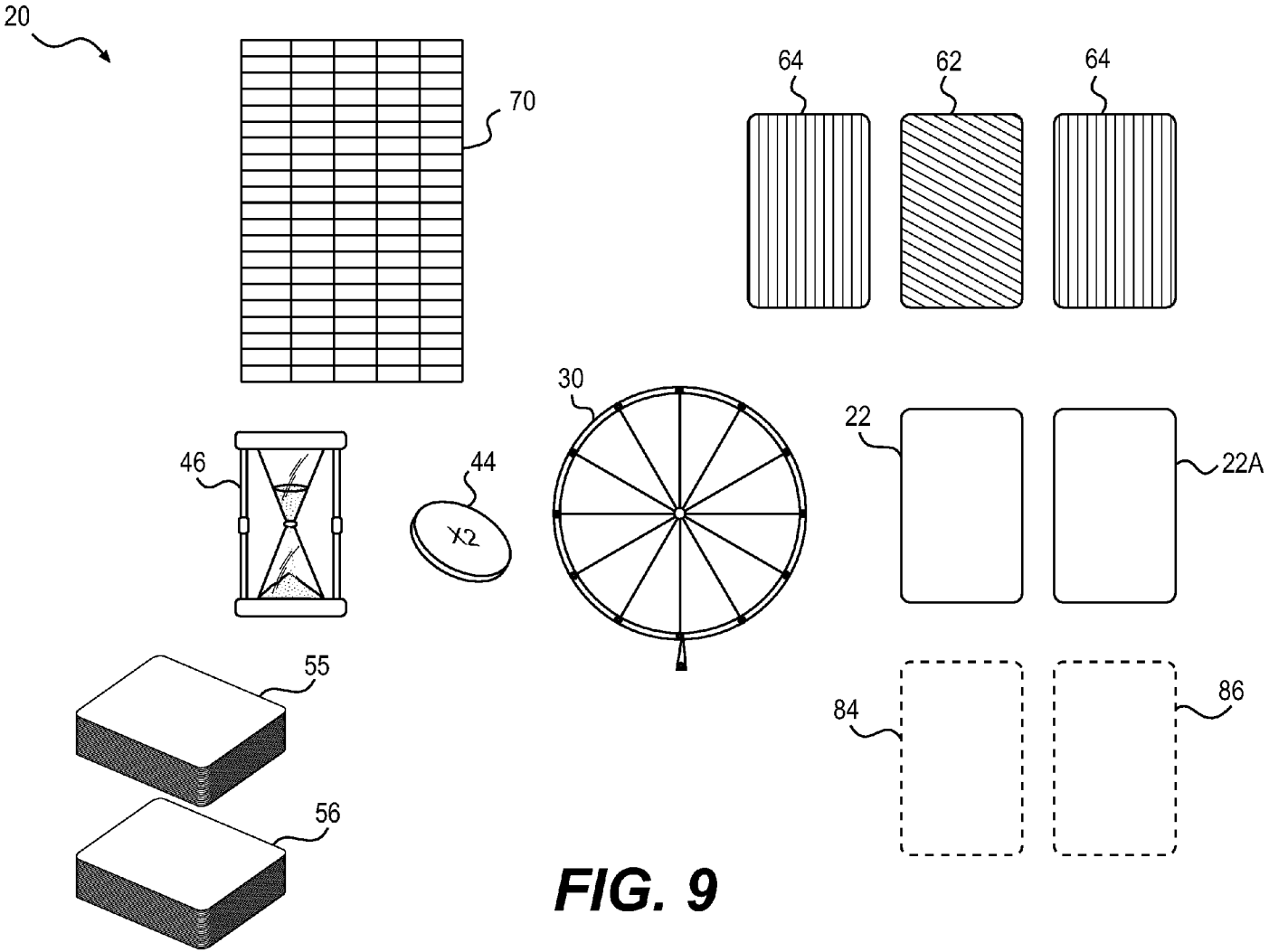
FIG. 9 depicts a sample compact layout of the game in accordance with the invention.

The game 20, as broadly embodied in FIG. 9, is designed to be laid out in a relatively compact arrangement, so that it can be played, if desired or if necessary, in a relatively compact area, e.g., on a coffee table, in a crowded apartment or dormitory room, on a relatively small desk, or even in certain circumstances on a fold-down table on an airplane or a train. The game, however, is not limited to being played in a small area. Should the players so desire, because the game is not limited to the confines of a game board, it also can be laid out in a larger space, e.g., a table, or a relatively large room. The layout of the game includes locations for the decks of celebrity cards 22, disadvantage cards 55, benefit cards 56, the random number generator 30 (in FIG. 9 the pivotal wheel), the timing device 46 (in FIG. 9 the sandglass), the coin 43, the help cards 62 and 64, and the scorecard 70. As depicted in FIG. 9, space can be allotted for two discard piles or "graveyards" 84 and 86, one for each team; although only a single "graveyard" is required.

In accordance with the invention, and as broadly embodied and described herein, the game 20 is designed to be played by teams, preferably at least two teams, and preferably with two or more players per team. Notwithstanding the above statement, a team can have a single player. It is not required that the number of players on each team be equal. Prior to starting the game, with reference to FIG. 10, players are divided into at least a first team 90 and an opposing second team 92, each of the first and second teams having at least one player.

In step 94, disadvantage cards 52, preferably two disadvantage cards, and benefit cards 58, are dealt to each team 90, 92. In step 96, help cards 60 are dealt, one to each player on each team 90, 92.

Figure 10:
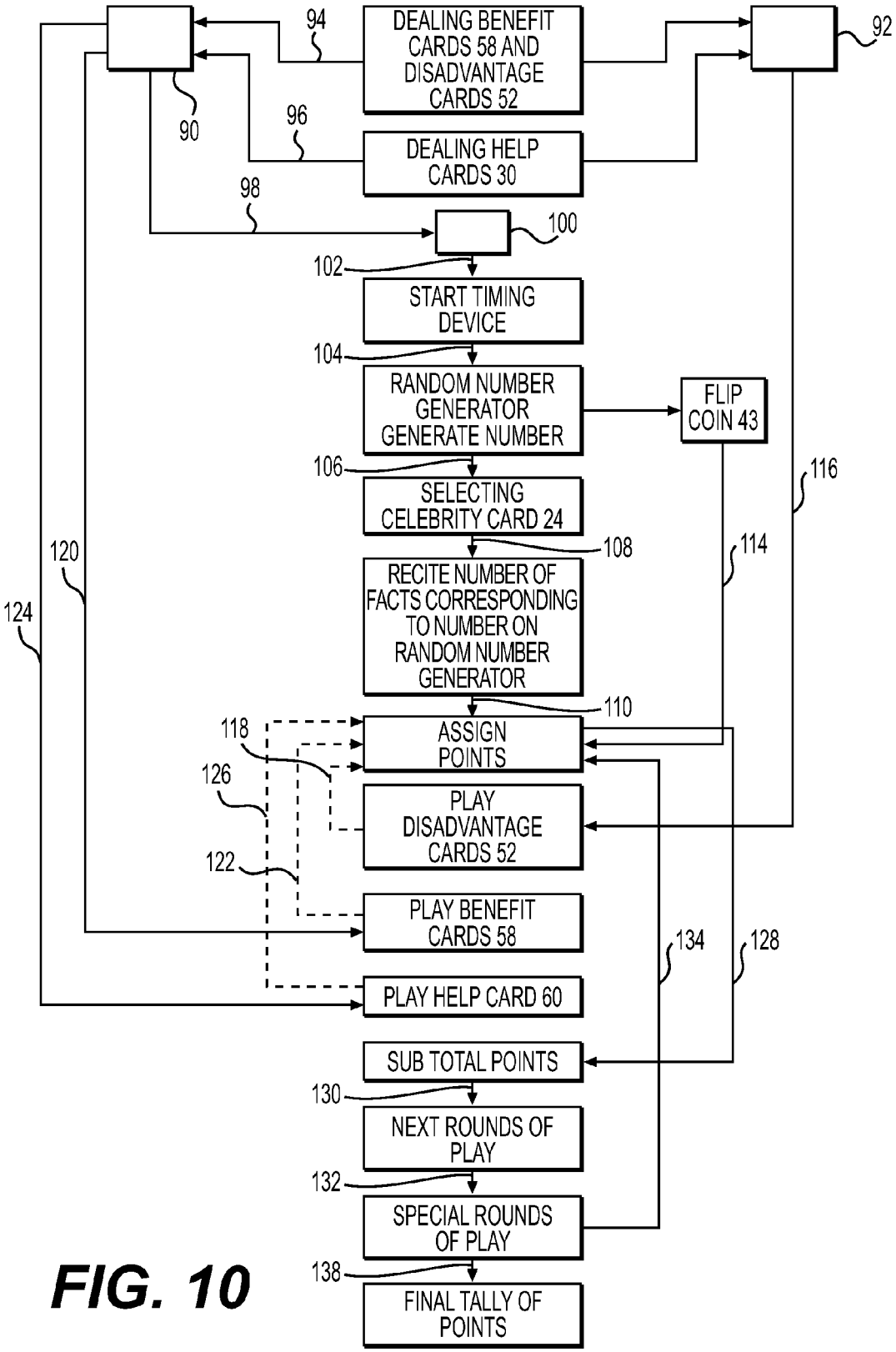
FIG. 10 depicts a flowchart for playing the game in accordance with the invention.

In step 98, a first player 100 is selected from one of the opposing teams, e.g., the first team 90 in FIG. 10.

First player 100 starts timing device 46 in step 102, thereby dictating a time of play for a first round of play.

First player 100, in step 104, manipulates the random number generator 30, in order to obtain a random number.

First player 100 also, in step 106, selects a celebrity card 24 with an image of a celebrity 26 thereon, and in step 108 begins reciting a number of facts related to the celebrity 26, corresponding to the number generated by the random number generator 30.

Alternatively, first player 100 could first manipulate the random number generator 30, next draw a celebrity card 24, and next start the timing device 46. The game is not limited to any particular sequence of steps.

The particular facts relate to the type of celebrity, and the version of the game 20 being played. For example, in the RED CARPET™ version of the game, first player 100 preferably may be required to recite names of a number of movies in which the celebrity movie star 26 starred, but this version of the game 20 is not limited to names of movies as the facts required. Moreover, other versions of the game 20 require different facts to be recited. For example, the "Popular Music Stars" version may require recitation of titles of a number of hit songs; the "Artists" version may require recitation of names of a number of Italian operas, or Impressionist paintings; the "Athletes version may require recitation of a number of Olympic medals won, years of World Cups won, years of Super Bowls won, and the like.

First player 100 must recite the number of facts within the time of play established by the timing device 46.

Points are assigned in step 110, based on the number of facts recited, according to a selected point-scoring system, e.g. 10 points for 1 fact/movie, 15 points for 3 facts/movies, 20 points for 5 facts. In the RED CARPET™ version, for the purpose of point scoring, it is preferred that series of movies, such as the "LORD OF THE RINGS," ®, "MATRIX," ® and "MAD MAX" ® series movies, respectively, count as only one movie, not as separate movies. If the player 100 recites fewer facts than the number indicated on the random number generator 30, 0 points are assigned. Also, if the player 100 recites more facts than the number indicated on the random number generator 30, he or she earns no additional points.

In certain cases, the random number generator 30 will instruct player 100 to flip the coin 43, depicted in FIG. 10 as step 112. As disclosed above, coin 43 has two faces 44, preferably a face 44 marked "-" and a face 44 marked "X2." The face 44 which lands face—up affects the scoring, step 114. For example, if the "-" face 44 lands face-up, and the player 100 fails to recite the required number of facts/movies negative points will be assigned, using the point-scoring system described herein. Alternately, if the "X2" face 44 lands face-up, the point totals assigned for naming the required number of facts are doubled using the point-scoring system described herein.

The point scoring, however, is not limited to the system described above; other point-scoring systems can be used and are within the scope of the invention.

Either after player 100 completes reciting his number of facts related to celebrity 26, or while the first player 100 is attempting to recite the required number of facts within the time of play of his or her round of play, players on the opposing team 92 can attempt to hinder him or her by playing disadvantage cards 52, including disadvantage requirements 54, e.g., "name additional facts for the celebrity," "name awards won,' "name co-stars," and so on. It is preferred that only one or two disadvantage cards 52 be playable per round of play, but the game 20 is not so limited. The response of the first player 100 to the particular disadvantage requirement 54 may affect the points assigned. Because his or her ability to answer the disadvantage requirement 54 and affect point scoring is uncertain, it is depicted in FIG. 10 with a dashed line 118. For example, if first player 100 cannot answer the disadvantage requirement 54 correctly, he loses the points obtained by reciting the required number of facts. Alternately, if first player 100 correctly answers the disadvantage requirements 54, he or she receives additional points, e.g., 5 additional points (or 10 additional points if the "X2" face 44 of coin 43 lies face up). Any disadvantage card 52, after being played, preferably is returned to its deck.

In step 120, while the first player 100 is attempting to recite the required number of facts about the celebrity 26, other players on his team 90 may play benefit cards 58, with benefit requirements 59. The benefit requirements 59, e.g. "pick another celebrity card," "manipulate random number generator again," "reduce number of facts to be recited," "ask teammate for help," and "Cancel played disadvantage card" may affect the scoring, and hence are depicted in FIG. 10 with a dashed line 122. As was the case with the disadvantage cards, each benefit card 58, once played, preferably is returned to its deck.

At selected times, preferably when the round of play for first player 100 is complete, another player on the same team 90 as the first player 100 with a help card 60 may elect in optional step 124 to play a help card 60. Help card 60 is available for play only if its "help" face 62 is face up. It cannot be played if the "already played" face 64 is face up. The player playing the help card 60 can help first player 100 in any way deemed adequate, e.g., giving him or her answer, or prompting him or her with a hint related to an answer. The help given may or may not affect the scoring, and so is depicted in FIG. 10 with a dashed line 126.

After the first player 100 completes his or her round of play, his points are sub-totaled in step 128 on scorecard 70 in an appropriate column, e.g., column 78, and his celebrity card 24 is discarded to the respective "graveyard" 84, 86. Subsequently, the played disadvantage cards 52 and benefit cards 58 can be shuffled and re-dealt, respective played help cards 60 are flipped back to the "help" side 62, and, in step 130, play is passed to a selected player on the opposing second team 92 to commence a second round of play. The steps of the second round of play are substantially identical to the first round of play. Subsequent rounds of play pass back and forth between players on each of the teams 90, 92, with points being subtotaled on scorecard 70 following each round of play.

After a selected number of rounds of play, preferably every three rounds, a Special Round is played in step 132. In the Special Round, celebrity cards 24 are shuffled and set down in an abbreviated deck 22A, help cards 60 are reset to the "help" side 62, and all disadvantage cards 52 and benefit cards 58 are returned to their decks, reshuffled, and dealt, preferably two benefit cards 58 per player and two disadvantage cards 52 per team. Players from each team 90, 92 pick several celebrity cards 24 from the abbreviated deck 22A, and the timing device 46 is started, giving a time of play. The players on the two teams look at the celebrities 26 printed on the cards 24 and recite celebrities 26 associated with one another, and the specific type of association. For example, the players may name an actor and an actress, along with a name of a movie, television series, or play in which they appeared together. Alternately, in other game versions, the players may name professional athletes and a name of a team on which they played together; musicians and a name of a band in which they toured and produced recordings; politicians and a name of a political party to which they each belong, or historical figures and a country or era to which they each belong. All players play simultaneously in the Special Round. Points are assigned during the Special Round, e.g., 15 points for each correct celebrity association. It further is preferred that a different association be required to be recited in each subsequent Special Round if the same celebrities 26 are re-drawn, in order to score points in the subsequent Special Rounds.

After all of the rounds of play, and all of the Special Rounds, for all of the players on both teams have been completed, the total number of points is tallied, step 136, on scorecard 70, and a winner is declared. Preferably, when the teams have an unequal number of players, the team with the highest average score will be declared the winner. As will be well understood, the average score is obtained by dividing a team's total score by the number of players on the team.

The game 20 in accordance with the invention, requiring a player to recite an unforeseeable number of facts about a celebrity within the constraint of a timing device, while opposing players attempt to hinder him or her, and teammates may attempt to assist, is mentally challenging and exciting, holds the attention of the players through the game's conclusion, and if necessary can be played either in a relatively compact space, or in a spread-out space, with all players actively participating, both those knowledgeable of celebrity trivia and those less-knowledgeable of celebrity trivia, thereby obviating the shortcomings of existing games.

Other embodiments of the invention will be apparent to those skilled in the art from consideration of the specification and practice of the invention disclosed herein. For example, in order to keep the game compact and versatile, the preferred embodiment disclosed above does not include a game board. The game 20 is not so limited however. Persons of ordinary skill could arrange a game board on which to set the random number generator, the different decks of cards, the timing device, and the "graveyard," without departing from the spirit or scope of the invention. Likewise, persons of ordinary skill could seek to digitize all of the components of the game disclosed above, and play the game of the invention on a desktop computer, an electronic notebook or pad, an electronic game device, a cell phone, or other electronic media. It is intended, therefore, that the specification and the disclosed preferred embodiment of the game and method of playing the game be considered as exemplary only, with a true scope and spirit of the invention being indicated by the following claims, and their legal equivalents.

What is claimed is:

1. A game comprising:

a plurality of celebrity cards, one said celebrity card selectable by a player in a round of play, the celebrity card including on one side thereof an image of a celebrity;

a random number generator operable to generate a random number corresponding to a required number of selected facts the player must recite about the celebrity;

a timing device establishing a time of a round of play, within which the player must recite the required number of selected facts;

a plurality of disadvantage cards distributable to a team opposing the player, playable by players on the opposing team during or after the round of play, each card having a disadvantage command to hinder the player from reciting the required number of selected facts;

a plurality of benefit cards, distributable to a team associated with the player playable by players on the associated team, each card having a benefit command to benefit the player in reciting the required number of selected facts, and to counter disadvantage cards played by the opposing team; and help cards distributable one to each player on each team, playable at a selected time, by a player on the associated team, to help the player recite the required number of selected facts.

2. The game of claim 1, further comprising a scorecard for recording variable numbers of points scored in association with the recitation of facts in the required number of facts, and facts in the disadvantage commands.

3. The game of claim 1, further comprising a coin, to be flipped based on a command from the random number generator, faces of which include commands related to the scoring of points.

4. The game of claim 1, wherein the celebrity cards depict movie stars, and the required number of facts include at least a number of movies in which the movie star appeared.

5. The game of claim 1, wherein the game is packaged with a pack of a first class of celebrity cards, and packs of disadvantage cards and benefit cards with respective disadvantage commands and benefit commands corresponding to the first class of celebrity cards.

6. The game of claim 1, wherein the game is packaged with a plurality of packs of separate classes of celebrity cards, and a plurality of packs of separate respective disadvantage and benefit cards, with respective disadvantage commands and benefit commands corresponding to each respective class of celebrity cards.

7. The game according to claim 1, wherein the celebrity cards include images of celebrities appearing in a class of celebrities selected from the group consisting of movie stars, athletes, fine artists, popular music stars, politicians, and historical figures.

8. The game according to claim 7, further comprising images of celebrities appearing in a plurality of classes of celebrities in the group of celebrities.

* * * * *